US007345425B2

(12) United States Patent
Kang et al.

(10) Patent No.: US 7,345,425 B2
(45) Date of Patent: Mar. 18, 2008

(54) PLASMA DISPLAY PANEL

(75) Inventors: Kyoung-Doo Kang, Suwon-si (KR); Won-Ju Yi, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 40 days.

(21) Appl. No.: 11/377,359

(22) Filed: Mar. 17, 2006

(65) Prior Publication Data

US 2006/0214598 A1 Sep. 28, 2006

(30) Foreign Application Priority Data

Mar. 25, 2005 (KR) ..... 10-2005-0024936

(51) Int. Cl.
*H01J 17/49* (2006.01)
*H01J 17/30* (2006.01)
*H01J 17/04* (2006.01)

(52) U.S. Cl. ..... 313/584; 313/610; 313/631

(58) Field of Classification Search ..... 313/483, 313/485, 502, 508, 509, 609, 610, 620, 621, 313/622, 581, 582, 584, 631, 243, 292, 306
See application file for complete search history.

(56) References Cited

U.S. PATENT DOCUMENTS

| | | | |
|---|---|---|---|
| 5,541,618 | A | 7/1996 | Shinoda |
| 5,661,500 | A | 8/1997 | Shinoda et al. |
| 5,663,741 | A | 9/1997 | Kanazawa |
| 5,674,553 | A | 10/1997 | Sinoda et al. |
| 5,724,054 | A | 3/1998 | Shinoda |
| 5,786,794 | A | 7/1998 | Kishi et al. |
| 5,952,782 | A | 9/1999 | Nanto |
| RE37,444 | E | 11/2001 | Kanazawa |
| 6,630,916 | B1 | 10/2003 | Shinoda |
| 6,707,436 | B2 | 3/2004 | Setoguchi et al. |
| 7,187,125 | B2 * | 3/2007 | Yoon et al. ..... 313/582 |

(Continued)

FOREIGN PATENT DOCUMENTS

| | | |
|---|---|---|
| JP | 2845183 | 10/1998 |

(Continued)

OTHER PUBLICATIONS

Korean Office action for Korean patent application No. 2005-0024936 issued on Aug. 29, 2006.

(Continued)

*Primary Examiner*—Thuy Vinh Tran
(74) *Attorney, Agent, or Firm*—Robert E. Bushnell, Esq.

(57) ABSTRACT

A plasma display panel having a new structure is provided. The plasma display panel includes a rear substrate, a front substrate spaced apart from the rear substrate, barrier ribs disposed between the front substrate and the rear substrate and defining a plurality of discharge cells, first discharge electrodes extending in a first direction and including a plurality of first loops surrounding the discharge cell, second discharge electrodes extending in a second direction, and including a plurality of second loops surrounding the discharge cell, and crossing the first discharge electrodes, and phosphor layers disposed in the discharge cells. The first discharge electrodes may operate as an address electrode, and the second discharge electrodes may operate as a scan electrode. The first loop and the second loop may have elliptical and circular shapes, respectively.

20 Claims, 6 Drawing Sheets

U.S. PATENT DOCUMENTS

| | | | | |
|---|---|---|---|---|
| 2004/0201350 | A1* | 10/2004 | Kwon et al. | 313/582 |
| 2004/0256989 | A1* | 12/2004 | Kim et al. | 313/584 |
| 2005/0001551 | A1* | 1/2005 | Kim et al. | 313/584 |
| 2005/0225241 | A1* | 10/2005 | Woo et al. | 313/582 |
| 2006/0170352 | A1* | 8/2006 | Jung et al. | 313/582 |
| 2006/0170353 | A1* | 8/2006 | Yoo et al. | 313/582 |

FOREIGN PATENT DOCUMENTS

| | | |
|---|---|---|
| JP | 11-25868 | 1/1999 |
| JP | 2917279 | 4/1999 |
| JP | 2001-043804 | 2/2001 |
| JP | 2001-325888 | 11/2001 |
| JP | 2001-345054 | 12/2001 |

OTHER PUBLICATIONS

"*Final Draft International Standard*", Project No. 47C/61988-1/Ed. 1; Plasma Display Panels—Part 1: Terminology and letter symbols, published by International Electrotechnical Commission, IEC. in 2003, and Appendix A—Description of Technology, Annex B—Relationship Between Voltage Terms And Discharge Characteristics; Annex C—Gaps and Annex D—Manufacturing.

* cited by examiner

PLASMA DISPLAY PANEL

CLAIM OF PRIORITY

This application makes reference to, incorporates the same herein, and claims all benefits accruing under 35 U.S.C. § 119 from an early application for PLASMA DISPLAY PANEL, earlier filed in the Korean Intellectual Property Office on the 25 Mar. 2005 and there duly assigned Ser. No. 10-2005-0024936.

BACKGROUND OF THE INVENTION

1. Field of the Invention

The present invention relates to plasma display panels generally, and more particularly, to plasma display panels producing an enhanced luminous efficiency.

2. Description of the Related Art

Recently, cathode-ray tube display devices have been replaced with plasma display panels in many applications. In a plasma display panel, discharge gas fills the void created between two substrates bearing a plurality of electrodes, and a discharge voltage is applied to the electrodes in order to generate ultraviolet rays. The ultraviolet rays excite phosphor layers formed in a predetermined pattern to form a variable visible image, corresponding to signals applied to drive the panel.

A plasma display panel includes a rear substrate and a front substrate facing each other. A plurality of address electrodes are arranged on an inner surface of the rear substrate. Barrier ribs are formed between the front substrate and the rear substrate to define discharge cells. Phosphor layers are coated on the surface in the discharge cells. Pairs of sustain electrodes crossing the address electrodes are formed on an inner surface of the front substrate. One of the pairs of the sustain electrodes is a X electrode, and the other is a Y electrode.

In the plasma display panel, discharge cells to emit light are selected by address discharge that is generated by applying an address voltage between the address electrodes and the Y electrodes, and the selected discharge cells emit light through sustain discharges generated by applying a sustain voltage between the X electrode and the Y electrode. A discharge gas that fills the discharge cells emits ultraviolet rays in response to the sustain discharge, and the ultraviolet rays make the phosphor layers emit visible rays. The visible light emitted from the phosphor layers forms an image on the plasma display panel.

There are requirements to increase luminous efficiency of a plasma display panel. The plasma display panel should have a large space for generating a sustain discharge which excites a discharge gas, a large surface area of phosphor layer, and fewer structures which interfere with the visible rays emitted from the phosphor layer.

Improving luminous efficiency of a plasma display panel, however, has been a difficult issue. The space for generating the sustain discharge is small, and only a small portion of the phosphor layer contributes to generate visible rays, because the sustain discharge is generated only in a narrow area between the X electrode and the Y electrode. Furthermore, a portion of visible rays emitted from the phosphor layer is absorbed or reflected by other structures formed in the plasma display panel such as a protective layer, dielectric layers, and sustain electrodes. A large amount of the visible light transmitted through the front substrate is thus wasted through interference with other structures. It is therefore one object of the present invention to provide a plasma display panel exhibiting greater luminous efficiency.

SUMMARY OF THE INVENTION

The present invention provides a plasma display panel having improved luminous efficiency. The present invention additionally provides a plasma display panel having improved brightness. The present invention also provides a plasma display panel having reduced reactive power.

According to an aspect of the present invention, there is provided a plasma display panel including a rear substrate, a front substrate spaced apart from the rear substrate, and barrier ribs disposed between the front substrate and the rear substrate to define a plurality of discharge cells. First discharge electrodes are disposed between the front substrate and the rear substrate and extend in a first direction, and second discharge electrodes are disposed between the front substrate and the rear substrate extending in a second direction, and phosphor layers disposed in the discharge cells.

The first discharge electrodes include a plurality of first loops surrounding the discharge cells. The second discharge electrodes include a plurality of second loops surrounding the discharge cells, and crossing the first discharge electrodes. A width of the first loop along the first direction is greater than a width of the first loop along the second direction.

In an exemplary embodiment, the first discharge electrodes may function as an address electrode, and the second discharge electrodes may function as a scan electrode. Furthermore, in the exemplary embodiment, the first discharge electrodes may surround the discharge cells in a substantially elliptical shape, and the second discharge electrodes may surround the discharge cells in a substantially circular shape.

In the exemplary embodiment, the first loop may have a least width along the second direction. Moreover, in that embodiment, the discharge cells may have a substantially elliptical horizontal cross-section.

In the exemplary embodiment, the first and second discharge electrodes may be disposed in the barrier ribs, and the phosphor layers may be disposed in an area defined by the front substrate, the first discharge electrodes, and second discharge electrode. At this time, grooves may be formed in an inner surface of the front substrate facing the discharge cells, and the phosphor layers may be disposed in the grooves. The grooves may be separately formed in each of the discharge cells.

Furthermore, in the exemplary embodiment, the barrier ribs may be formed of a dielectric material, and the barrier ribs may be integrally formed with the front substrate. Also, in the exemplary embodiment, the front substrate and the first discharge electrodes may be disposed in parallel, and the front substrate and the second discharge electrodes may be disposed in parallel.

The plasma display panel constructed according to the principles of the present invention has several advantages.

First, because the adjacent first discharge electrodes are spaced apart from each other, a reactive power is reduced and thus luminous efficiency is improved. Second, because a surface discharge can be generated on entire side surfaces the discharge cell, the plasma display panel provides an enlarged discharge surface. Third, a sustain discharge is initially generated on surfaces of a barrier rib defining a discharge cell, and subsequently spreads into the center of the discharge cell. Therefore, the plasma display panel provides a large discharge volume, and thus the discharge process can be efficiently managed. Accordingly, a low voltage driving of the plasma display panel can be realized, and thus luminous efficiency can be remarkably improved. Fourth, because of the advantages described above, the low voltage driving of the plasma display panel can be realized even if a gas with high-concentration of xenon is used as the discharge gas. Therefore, the luminous efficiency can be further improved. Fifth, a higher discharge response speed at the low voltage driving of a plasma display panel can be realized. More specifically, the discharge electrode is disposed on the side of the discharge cell, instead of on the front substrate which transmits visible rays. Accordingly, transparent electrodes having a high resistance are not necessary in the plasma display panel built according to the principles of the present invention. Thus, non-transparent electrode materials having a low resistance such as a metal can be used for the discharge electrode, and high discharge response speed and low voltage driving of the plasma display panel can be realized without distortion of voltage waveforms.

BRIEF DESCRIPTION OF THE DRAWINGS

A more complete appreciation of the invention and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
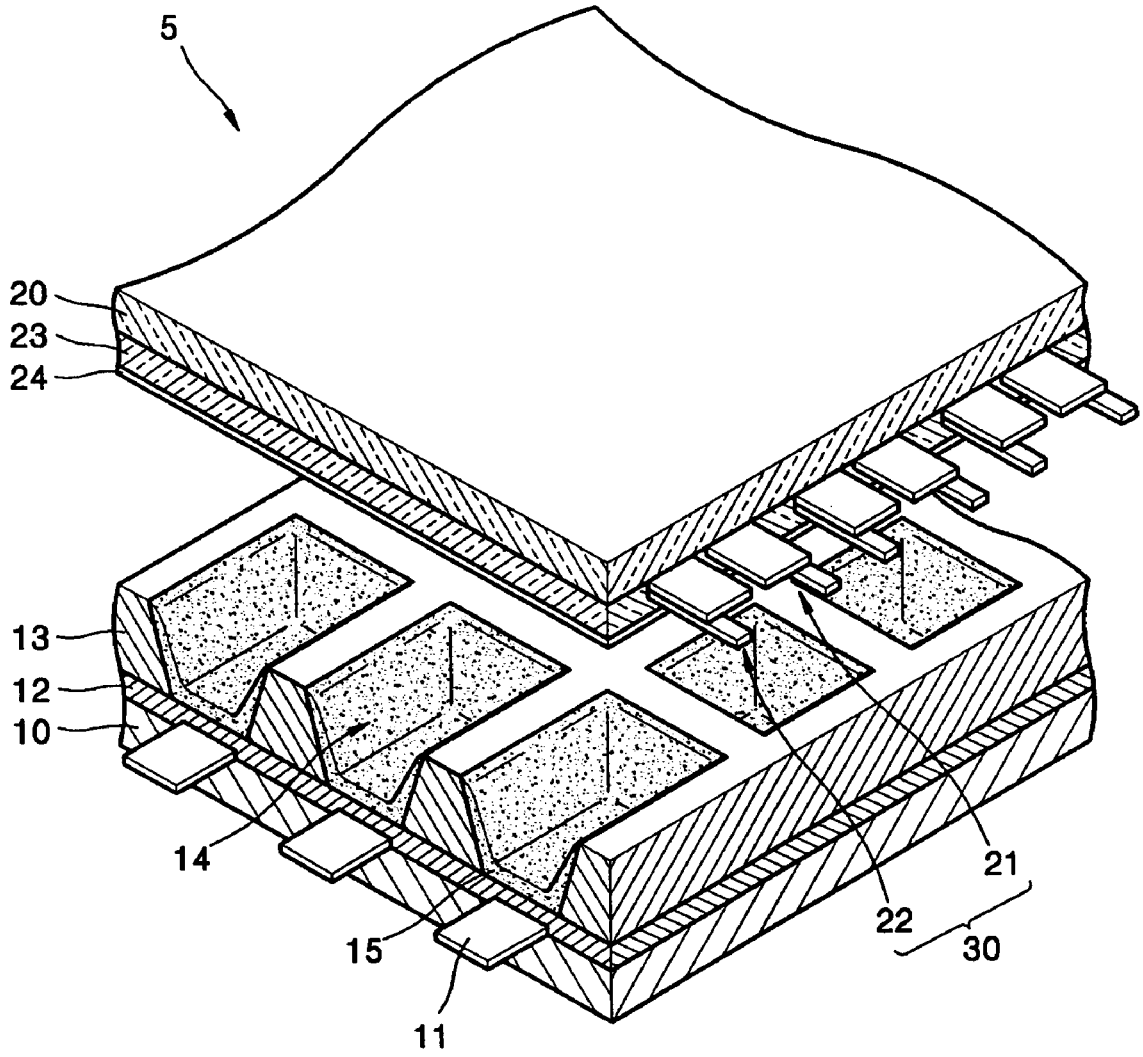
FIG. 1 is a partially exploded perspective view of a plasma display panel.

FIG. 1 is an exploded perspective view of an AC type three-electrode surface discharge plasma display panel 5. Referring to FIG. 1, plasma display panel 5 includes a rear substrate 10 and a front substrate 20 facing each other. A plurality of address electrodes 11 are arranged on a front surface of the rear substrate 10, and buried in a first dielectric layer 12. Barrier ribs 13 are formed on a front surface of the first dielectric layer 12 defining discharge cells 14. Phosphor layers 15 are coated to a predetermined thickness in the discharge cells 14 defined by the barrier ribs 13. The front substrate 20 is a transparent substrate which transmits visible rays and is mainly made of glass. The front substrate 20 is coupled to the rear substrate 10 having the barrier ribs 13. Pairs of sustain electrodes 30 crossing the address electrodes 11 are formed on a rear surface of the front substrate 20. One of a pair of the sustain electrodes 30 is an X electrode 21, and the other is a Y electrode 22. The pairs of the sustain electrodes 30 are buried in a second dielectric layer 23, and a protective layer 24 is formed on a rear surface of the second dielectric layer 23.

In the plasma display panel having this structure, discharge cells 14 to emit light are selected by address discharge generated between the address electrode 11 and the Y electrodes 22, and the selected discharge cells 14 emit light by sustain discharge generated between the X electrode 21 and the Y electrode 22 thereof. More particularly, a discharge gas filled in the discharge cells 14 emits ultraviolet rays by the sustain discharge, and the ultraviolet rays make the phosphor layers 15 to emit visible rays. The visible light emitted from the phosphor layers 15 forms an image for the plasma display panel.

The plasma display panel 5 having the aforementioned structure, however, has a smaller space for generating the sustain discharge and a smaller surface area of the phosphor layer 15, because the sustain discharge is generated only in a space between the X electrode 21 and the Y electrode 22, which are adjacent to the protective layer 24. Furthermore, because a portion of visible rays emitted from the phosphor layer 15 is absorbed or reflected by the protective layer 24, the second dielectric layer 23, and the sustain electrodes 21 and 22, an amount of the visible light transmitted through the front substrate 20 is only 60% of the amount of the visible light emitted from the phosphor layer 15.

An embodiment of the present invention will be described in detail with reference to FIGS. 2 through 6.

Figure 2:
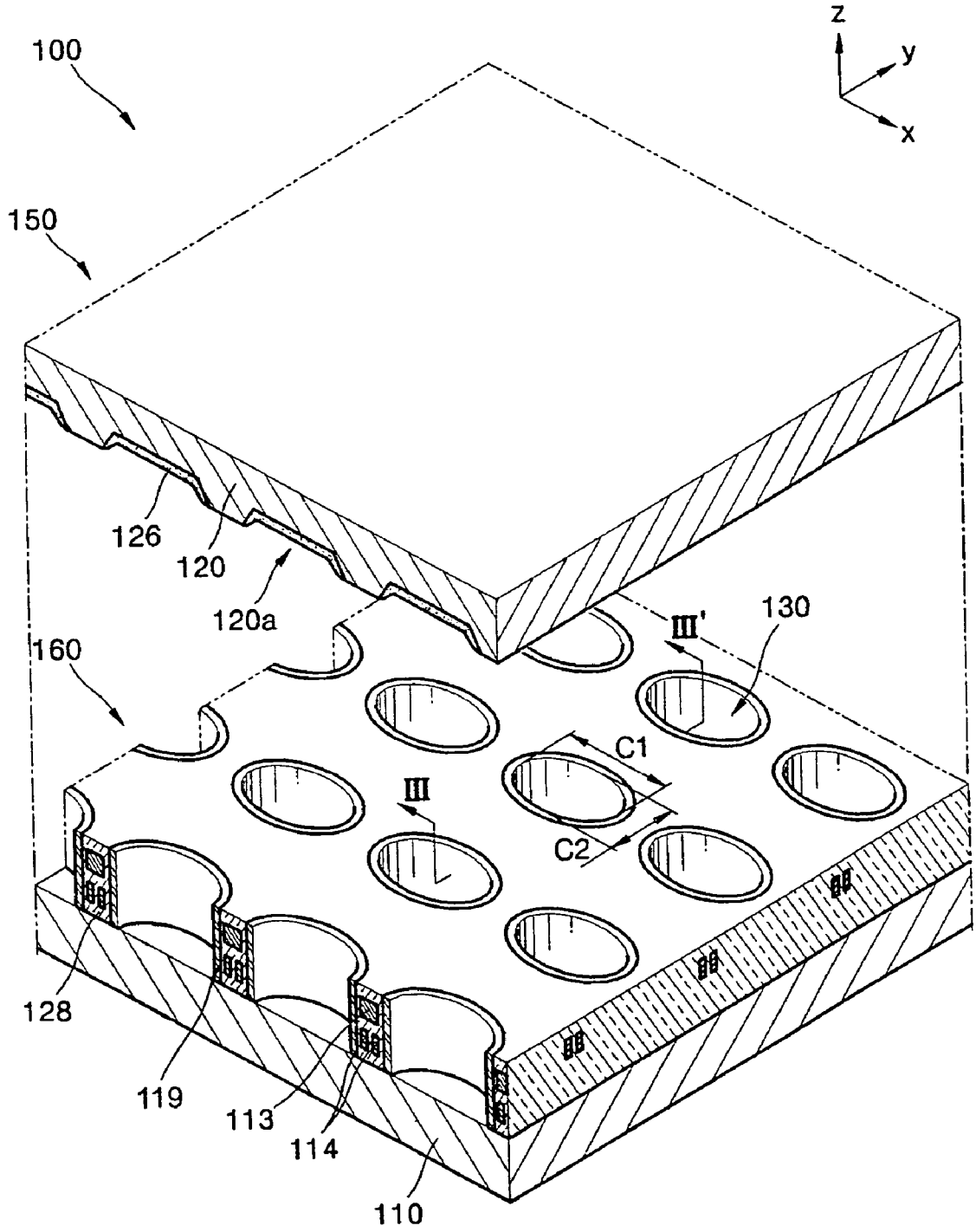
FIG. 2 is a partial exploded perspective view of a plasma display panel constructed according to principles of the present invention.
Figure 3:
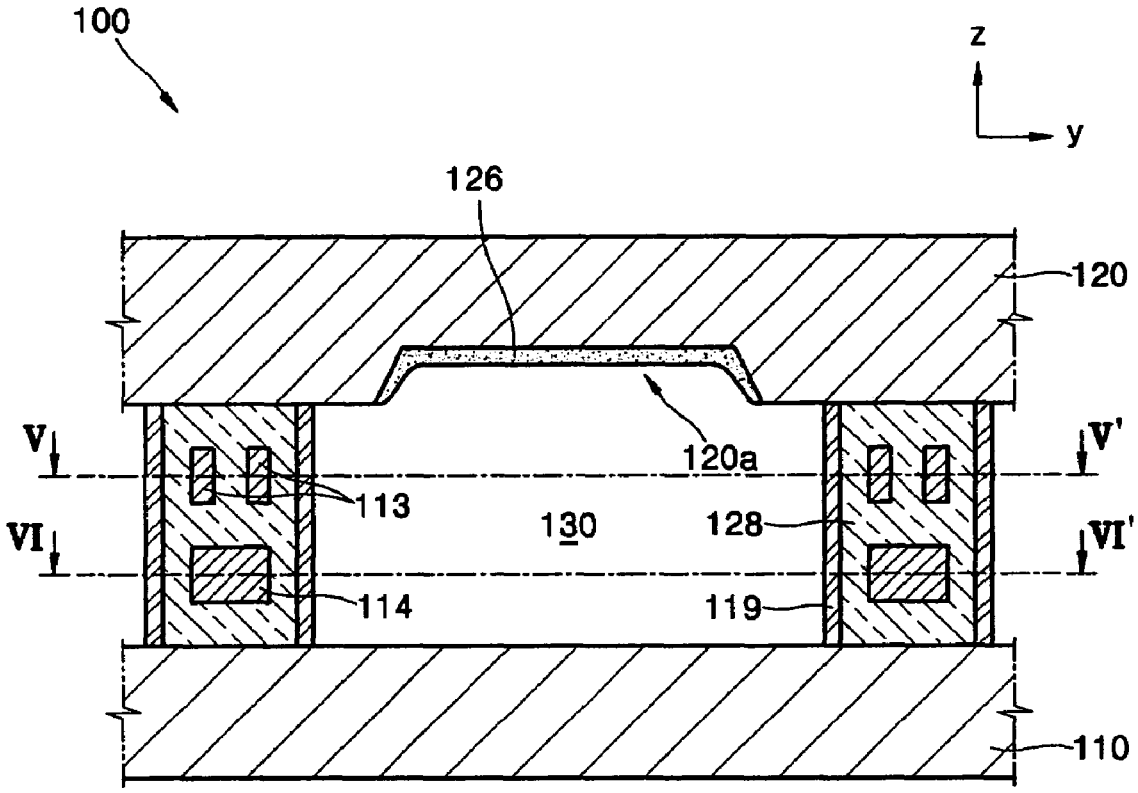
FIG. 3 is a cross-sectional view taken along line III-III' of FIG. 2.

Referring to FIGS. 2 and 3, a plasma display panel 100 constructed as an embodiment of the present invention includes an upper plate 150 and a lower plate 160. The upper plate 150 includes a front substrate 120, phosphor layers 126, barrier ribs 128, first discharge electrodes 113, second discharge electrodes 114, and protective layers 119, and the lower plate 160 includes a rear substrate 110.

The rear substrate 110 and the front substrate 120 are spaced apart from each other, and the barrier ribs 128 formed therebetween define a plurality of discharge cells 130. The front substrate 120, which transmits visible rays generated at the discharge cells 130, may be made of a material having characteristics of excellent light transmission, such as glass. The rear substrate 110 may also be made of glass.

Referring to FIGS. 2 and 3, discharge cells 130 are disposed in an array structure, and the barrier ribs 128 are formed to make the horizontal cross-sections of the discharge cells 130 have an elliptical shape. In the present embodiment, the discharge cell 130 having a shape of an ellipse has a major diameter C1 (a length along x-axis) and a minor diameter C2 (a length along y-axis). First discharge electrodes 113 extend along the major axis of the ellipse (x-axis), and second discharge electrodes 114 extend along the minor axis of the ellipse (y-axis). However, the shape of the barrier rib 128 is not limited to the shapes described in the present embodiment. The barrier rib 128 may be formed in various patterns such as a waffle or delta pattern, as long as a plurality of the discharge cells can be formed in such a pattern. Also, the horizontal cross-section of the discharge cell may be triangular, rectangular, pentagonal, circular, or elliptical. Discharge cells with a circular shape have an advantage that the discharge is uniformly generated over the entire sides of the discharge cells 130. In the present embodiment, it is preferable that the barrier ribs 128 are integrally formed with the front substrate 120. Here, the term "integrally" does not mean that the front substrate 120 and the barrier ribs 128 are simultaneously formed in the same process, but means that the front substrate 120 and the barrier ribs 128 are tightly coupled to each other so that the front substrate 20 and the barrier ribs 128 may not be easily separated from each other.

Figure 4:
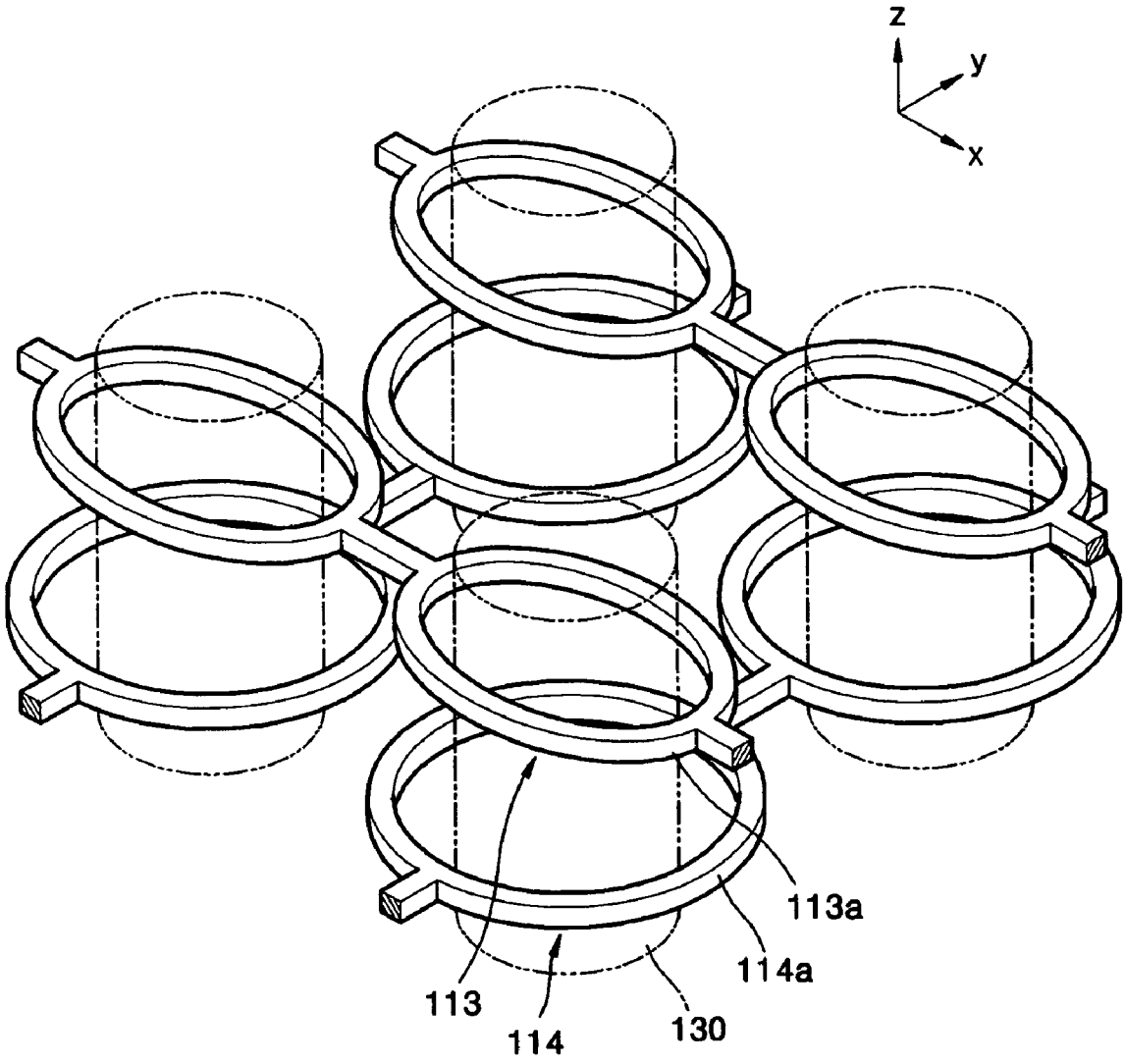
FIG. 4 is a schematic layout diagram of the discharge cells, and the first and second discharge electrodes shown in FIG. 2.
Figure 5:
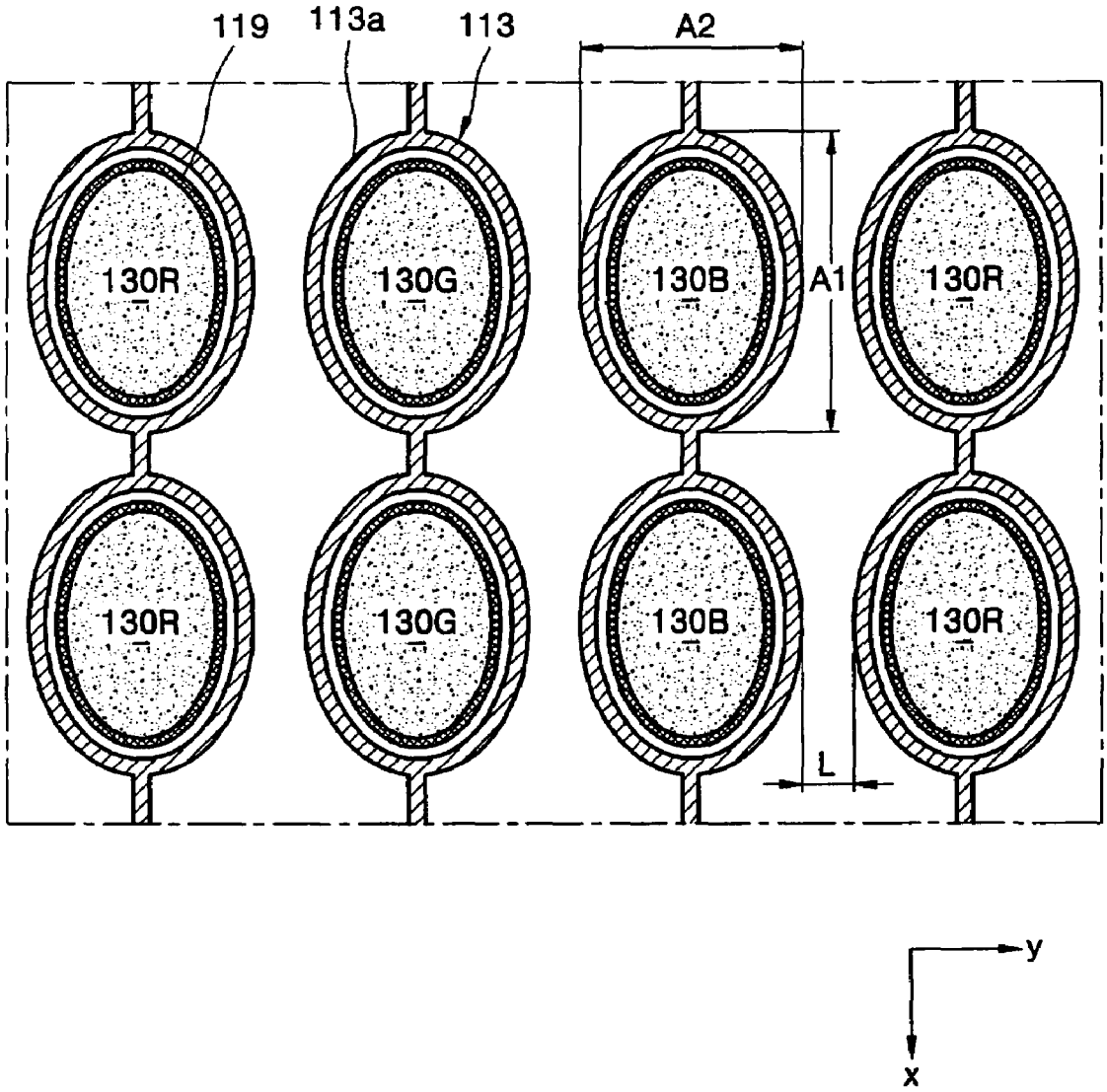
FIG. 5 is a layout diagram of the discharge cells, and the first discharge electrodes taken along line V-V' of FIG. 3.
Figure 6:
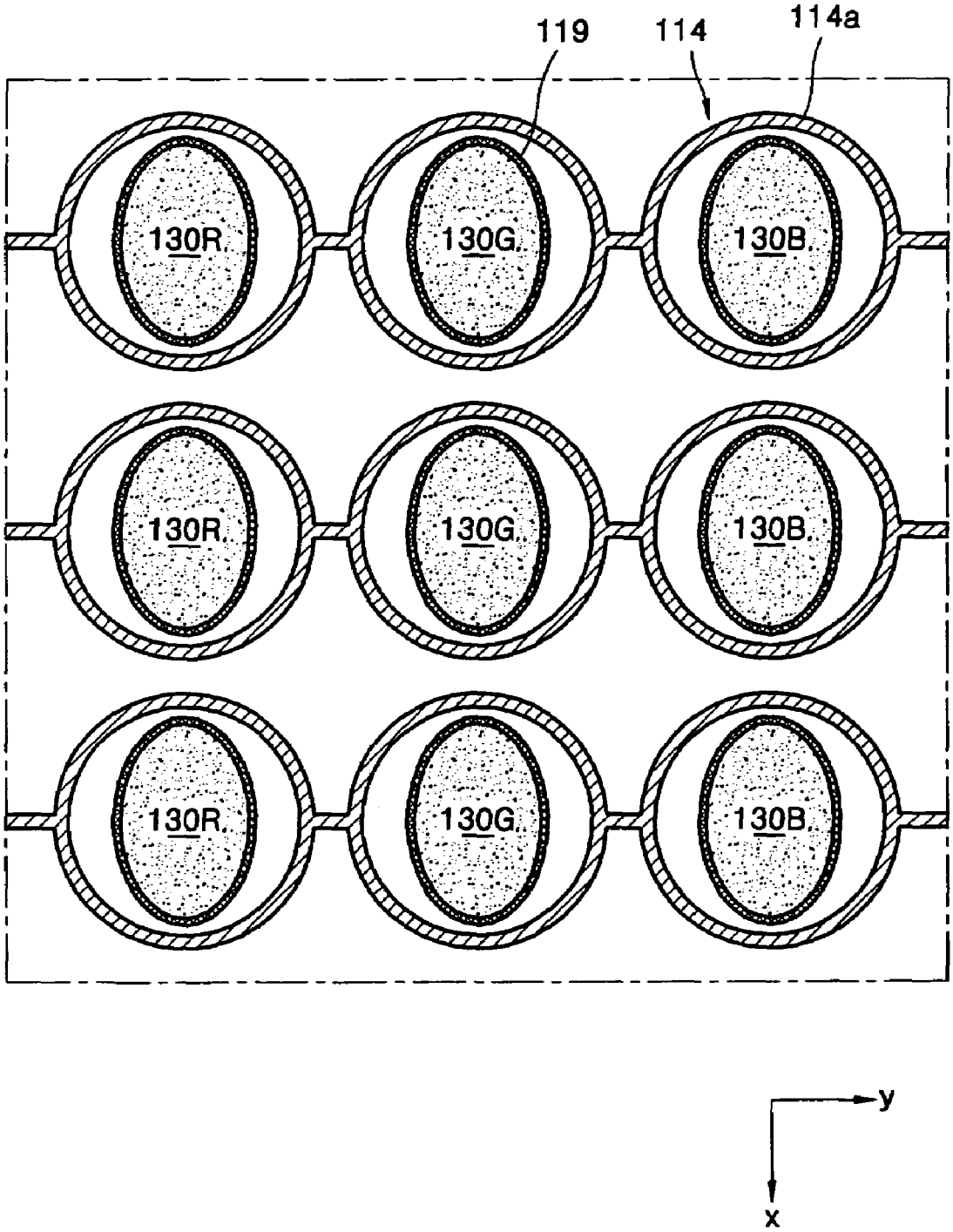
FIG. 6 is a layout diagram of the discharge cells, and the second discharge electrodes taken along line VI-VI' of FIG. 3.

Referring to FIGS. 4 through 6, first discharge electrodes 113 and second discharge electrodes 114 are disposed to surround the discharge cells 130. The first discharge electrodes 113 and the second discharge electrodes 114 are spaced apart from each other in the barrier ribs 128, and the first discharge electrodes 113 and the second discharge electrodes 114 are disposed in parallel with the front substrate 120. More particularly, the first discharge electrodes 113 are disposed closer to the front substrate 120 than the second discharge electrodes 114 in a vertical direction (z direction), and the first discharge electrodes 113 and the second discharge electrodes 114 extend in parallel with the front substrate 120. Furthermore, the first discharge electrodes 113 extend in a first direction (x direction) surrounding each of the discharge cells 130 arrayed in the first direction (x direction), and the second discharge electrodes 114 extend in a second direction (y direction) crossing the first discharge electrodes 113 and surrounding each of the discharge cells 130 arrayed in the second direction (Y direction).

Each of the first discharge electrodes 113 is formed by connecting a plurality of elliptical loops 113*a*, and each of the second discharge electrodes 114 is formed by connecting a plurality of circular loops 114*a*. Particularly, a loop 113*a* of first discharge electrodes 113 has a major diameter A1 and a minor diameter A2. Because a major axis of the ellipse is parallel to the first direction (x-axis) and a minor axis of the ellipse parallel to the second direction (y-axis), an elliptical loop 113*a* has the smallest width along the second direction. This elliptical shape of the loops 113*a* provides an advantage of reduced reactive power, which will be described in detail later. Here, the shapes of the first discharge electrodes 113 and the second discharge electrodes 114 are not limited to the shapes illustrated in the present embodiment, and may have various shapes.

A plasma display panel 100 built according to the principles of the present invention has a two-electrode structure. Accordingly, any one of the first discharge electrode 113 and the second discharge electrode 114 functions as a scan electrode, and the other thereof functions as an address electrode. In the present embodiment, the first discharge electrode 113 functions as the address electrode, and the second discharge electrode 114 functions as the scan electrode. Because the first discharge electrodes 113 and the second discharge electrodes 114 are disposed inside the barrier ribs 128, the first discharge electrodes 113 and the second discharge electrodes 114 do not interfere with visible rays transmitting into the front substrate (along z direction). Accordingly, the first discharge electrodes 113 and the second discharge electrodes 114 can be made of metal having excellent electrical conductivity, such as aluminum or copper, instead of indium tin oxide (ITO), and therefore a voltage drop generated lengthwise along electrodes is reduced and an electrical signal applied to the electrodes becomes more stable without distortions.

The barrier ribs 128 are preferably formed of a dielectric material, which prevents the adjacent first and second discharge electrodes 113 and 114 from being electrically connected to each other, prevents the electrodes 113 and 114 from being damaged by directly colliding with positive ions or electrons, and have the electrodes 113 and 114 induce charges to store wall charges.

Grooves 120*a* are formed in a rear surface of the front substrate 120 facing the discharge cells 130. It is preferable that a groove 120*a* is separately formed in each of the discharge cells 130, and is formed at locations facing the center of the discharge cell 130. Here, the shape of the groove 120*a* is not limited to the shape described in this embodiment.

The grooves 120*a* have a predetermined depth. Accordingly, a thickness of the front substrate 120 is reduced by the depth of the grooves 120*a*, and therefore the transmission of visible rays through the front substrate 120 (z direction) increases.

Red, green, and blue phosphor layers 126 are formed in the grooves 120*a* by a predetermined thickness. The location of the phosphor layer 126, however, is not limited to these locations described in the present embodiment, and the phosphor layer 126 may be disposed at various locations in the discharge cell 130. It is preferable that the phosphor layer 126 is disposed at a space defined by the front substrate 120, the first discharge electrode 113, and the second discharge electrodes 114.

The phosphor layers 126 have substances for receiving ultraviolet rays and generating visible rays. As shown in FIG. 5, a red phosphor layer formed in a discharge cell 130R for generating red color may contain phosphor substance such as $Y(V,P)O_4$:Eu, a green phosphor layer formed in a discharge cell 130G for generating green color may contain phosphor substance such as $Zn_2SiO_4$:Mn, and a blue phosphor layer formed in a discharge cell 130B for generating blue color may contain phosphor substance such as BAM:Eu.

The discharge cell 130R in which the red phosphor layer is disposed corresponds to a red sub-pixel, the discharge cell 130G in which the green phosphor layer is disposed corresponds to a green sub-pixel, and the discharge cell 130B in which the blue phosphor layer is disposed corresponds to a blue sub-pixel.

It is preferable that the protective layers 119 are formed at the sides of the barrier ribs 128 that is formed of a dielectric material by sputtering plasma particles. The protective layers 119 prevent the first and second discharge electrodes 113 and 114 and the barrier ribs 128 from being damaged, and emit secondary electrons lowering a discharge voltage. The protective layers 119 may be formed by coating magnesium oxide (MgO) on the sides of the barrier ribs 128 by a predetermined thickness. The protective layer 119 is formed of a thin film mainly using a sputtering method or an E-beam evaporation method.

A discharge gas such as neon, xenon, or a gas mixture thereof is filled in the discharge cells 130. Because a plasma display panel built according to the principles of the present invention has an increased discharge surface, an enlarged discharge space, and an increased amount of plasma, the plasma display panel can be operated at a lower driving voltage. Thus, in the embodiment of the present invention, although a gas with a high concentration of xenon is used as the discharge gas, the low voltage driving of the plasma display panel can be realized, and thus the luminous efficiency of the plasma display panel can be remarkably improved. Accordingly, a plasma display panel built according to the principles of the present invention provides a solution to achieve a lower driving voltage in a plasma display panel that uses high concentration of xenon.

The operation of the plasma display panel 100 according to the embodiment of the present invention will now be described.

An address voltage is applied between the first discharge electrode 113 and the second discharge electrode 114 to generate an address discharge, and thus the discharge cells 130 in which sustain discharge will be generated are selected. Thereafter, when a discharge sustain voltage is applied between the first discharge electrode 113 and the second discharge electrode 114 of the selected discharge cells 130, wall charges stored in the first discharge electrode 113 and the second discharge electrode 114 move to generate a sustain discharge, and ultraviolet rays are emitted while an energy level of the discharge gas excited by the sustain discharge drops. The ultraviolet rays excite the phosphor layers 126 coated in the discharge cells 130 to emit visible rays when an energy level of the excited phosphor layers 126 are lowered. Thus, the visible rays sequentially pass through the phosphor layers 126 and the front substrate 120 forming an image which can be recognized by a user.

However, when different voltages are applied to the adjacent electrodes, there is an issue of an increased consumption of reactive power. Reactive power is generated by a displacement current, and the displacement current is proportional to a capacitance and variation of a voltage with respect to time. Accordingly, when different voltage pulses are applied to the adjacent electrodes, the displacement current is generated by the variation of the voltage. At this time, the capacitance between the adjacent electrodes is proportional to a relative dielectric constant and a facing area of the electrodes, and is inversely proportional to a distance between the electrodes. Accordingly, when the distance between the electrodes is small, the capacitance increases, the displacement current increases, and thus the reactive power increases.

In the present embodiment, the second discharge electrodes 114 function as a scan electrode. Therefore, except for a time period when the scan pulse is input, voltages applying to each of the second discharge electrodes 114 are substantially the same. Various voltages, however, may be applied to the first discharge electrodes 113 which function as an address electrode. For example, address voltage pulses may be applied to some of the first discharge electrodes 113 disposed in discharge cells 130 that are selected to generate specific address discharges, and may not be applied to the rest of the first discharge cells 113. Particularly, the variation of the voltage pulses applied to the first discharge electrodes 113 is larger when displaying a specific image pattern (for example, a dot-on-off image pattern). Also, because the voltage pulses applied to the first discharge electrodes 113 are more frequently varied than the scan voltage pulses applied to the second discharge electrodes 114 which function as the scan electrode, the consumption of reactive power increases.

Accordingly, it is preferable that the first discharge electrodes 113 are spaced apart from each other to reduce the reactive power consumption. However, when the first discharge electrodes 113 are excessively spaced apart from each other, the size of the sub-pixel increases, and thus a high resolution plasma display panel may not be realized. Accordingly, an electrode shape capable of reducing the distance between first discharge electrodes 113, while maintaining of a regular shape and size of a sub-pixel, is required.

In the present embodiment, the first discharge electrodes 113 surround the discharge cells 130 while having an elliptical shape, and the elliptical shape has a shorter minor diameter A2 along the second direction (y direction). Therefore, the distance L between the adjacent two first discharge electrodes 113 is relatively large as shown in FIG. 5.

Furthermore, in a plasma display panel shown in FIG. 1, the sustain discharge between the sustain electrodes 21 and 22 is generated in the horizontal direction parallel to a substrate 20, and thus the discharge area is relatively narrow. However, the sustain discharge of the plasma display panel 100 built according to the principles of the present invention is generated on the entire sides of the barrier ribs 128 that define the discharge cells 130, and thus the discharge area is relatively wide.

In the present embodiment, the sustain discharge first occurs in a closed curve along the side surfaces of the discharge cell 130, and gradually spread to the center of the discharge cell 130. Accordingly, the size of a region in which the sustain discharge is generated increases, and space charges in the discharge cell, which are not supposed to be used in the sustain discharge, begin to contribute to the sustain discharge. Thus, the luminous efficiency of the plasma display panel is improved.

Furthermore, in the plasma display panel built according to principles of the present invention, because the sustain discharge is generated at the center of the discharge cell 130, ion sputtering of the phosphor layer 126 caused by the charged particles does not occur, and thus there is no permanent image sticking effect although the same image is displayed for a long time.

According to the plasma display panel of the embodiment of the present invention, a plasma display panel having improved luminous efficiency and brightness can be manufactured.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A plasma display panel, comprising:

a rear substrate;

a front substrate spaced apart from the rear substrate;

a plurality of barrier ribs disposed between the front substrate and the rear substrate;

a plurality of discharge cells defined by the barrier ribs, the rear substrate, and the front substrate;

a plurality of first discharge electrodes disposed between the front substrate and the rear substrate and extending in a first direction, said first discharge electrodes defining a plurality of first loops surrounding the discharge cells;

a plurality of second discharge electrodes disposed between the front substrate and the rear substrate and extending in a second direction crossing the first discharge electrodes, said second discharge electrode defining a plurality of second loops surrounding the discharge cells; and phosphor layers disposed in the discharge cells.

2. The panel according to claim 1, comprised of a width of the first loop along the first direction being greater than a width of the first loop along the second direction.

3. The panel according to claim 1, comprised of an address voltage signal applied to the first discharge electrodes providing an address discharge, and a scan voltage signal applied to the second discharge electrodes providing a scan discharge.

4. The panel according to claim 1, wherein a width of the first loops along the second direction is the smallest.

5. The panel according to claim 1, comprised of the first loops being substantially elliptical in shape.

6. The panel according to claim 1, comprised of the second loops being substantially circular in shape.

7. The panel according to claim 1, comprised of a horizontal cross-section of the discharge cell being substantially elliptical.

8. The panel according to claim 1, comprised of the first and the second discharge electrodes being embedded within the barrier ribs.

9. The panel according to claim 1, comprised of at least one phosphor layer being disposed in each of the discharge cells in a space collectively defined by the front substrate, the first discharge electrode, and the second discharge electrode.

10. The panel according to claim 1, comprised of a plurality of grooves formed in an inner surface of the front substrate.

11. The panel according to claim 10, comprised of the phosphor layers being formed in the grooves.

12. The panel according to claim 10, comprised of at least one groove being separately formed in each of the discharge cells.

13. The panel according to claim 1, comprised of the barrier ribs being made of a dielectric material.

14. The panel according to claim 1, comprised of the barrier ribs being integrally formed with the front substrate.

15. The panel according to claim 1, comprised of the front substrate and the first discharge electrodes being substantially parallel.

16. The panel according to claim 1, comprised of the front substrate and the second discharge electrodes being disposed in parallel.

17. A plasma display panel, comprising:

a front substrate spaced apart from a rear substrate;

a plurality of barrier ribs disposed in an array between the front substrate and the rear substrate;

a plurality of discrete discharge cells collectively defined by the barrier ribs, the front substrate and the rear substrate;

a plurality of first discharge electrodes extending in a first direction, disposed between the front substrate and the rear substrate, to define a plurality of first loops surrounding the discharge cells;

a plurality of second discharge electrodes extending in a second direction crossing said first direction, disposed between the front substrate and the rear substrate, to define a plurality of second loops surrounding the discharge cells;

a width of the first loops in said first direction being greater than a width of the first loops in said second direction; and phosphor layers disposed in the discharge cells.

18. The plasma display panel of claim 17, comprised of said plurality of second discharge electrodes being substantially circular in shape.

19. A plasma display panel, comprising:

a front substrate spaced apart from a rear substrate;

a plurality of barrier ribs disposed in an array between the front substrate and the rear substrate;

a plurality of discrete discharge cells collectively defined by the barrier ribs, the front substrate and the rear substrate;

a plurality of first discharge electrodes extending in a first direction, disposed between the front substrate and the rear substrate, to define a plurality of first substantially elliptically shaped loops surrounding the discharge cells;

a plurality of second discharge electrodes extending in a second direction crossing said first direction, disposed between the front substrate and the rear substrate, to define a plurality of second loops surrounding the discharge cells;

a width of the first loops in said first direction being greater than a width of the first loops in said second direction; and phosphor layers disposed in the discharge cells.

20. The plasma display panel of claim 19, comprised of said plurality of second discharge electrodes being substantially circular in shape.

* * * * *